US005915866A

United States Patent [19]

Furukawa

[11] Patent Number: 5,915,866

[45] Date of Patent: Jun. 29, 1999

[54] CLICKING-TYPE BALL POINT PEN

[75] Inventor: Kazuhiko Furukawa, Kanagawa, Japan

[73] Assignee: Mitsubishi Pencil Kabushiki Kaisha, Tokyo, Japan

[21] Appl. No.: 09/003,847

[22] Filed: Jan. 7, 1998

[30] Foreign Application Priority Data

Feb. 26, 1997 [JP] Japan ..... 9-057183

[51] Int. Cl.[6] ..... B43K 5/16

[52] U.S. Cl. ..... 401/106; 401/105; 401/104

[58] Field of Search ..... 401/106, 105, 401/104, 109, 117

[56] References Cited

U.S. PATENT DOCUMENTS

| | | | |
|---|---|---|---|
| 3,796,501 | 3/1974 | Zepell | 401/106 |
| 3,955,893 | 5/1976 | Pulaski | 401/106 |
| 5,152,626 | 10/1992 | Eppler | 401/106 |
| 5,454,655 | 10/1995 | Chiswell | 401/106 |

FOREIGN PATENT DOCUMENTS

| | | |
|---|---|---|
| 72479 | 3/1996 | Japan . |
| 142577 | 6/1996 | Japan . |
| 230386 | 9/1996 | Japan . |

*Primary Examiner*—David J. Walczak
*Attorney, Agent, or Firm*—Darby & Darby

[57] ABSTRACT

A clicking-type ball point pen has a so-called double-clicking mechanism in which a clicking rod is projected by depression and is retracted by further depression. At least one undercut is formed in the inner surface of a rear barrel cylinder or a component fixed to the rear barrel cylinder to prevent a rotor and the clicking rod from being removed forward from the barrel cylinder. The barrel cylinder incorporates a writing element having a large diameter. A point assembly holder at the distal end of the barrel cylinder has a straight portion, which constantly urges a writing ball forward with a load of 1 g to 80 g, and an elastic portion having spring properties integrally, or in a contact state if the straight portion and the elastic portion are separate components. An ink present from the interior of the point assembly to a follower is defoamed such that a gas, e.g., air, water vapor, or a gas formed of a vaporized organic solvent, which is larger than 0.524 $mm^3$ (a volume of a sphere having a diameter of 1.0 mm) is absent therein.

8 Claims, 5 Drawing Sheets

CLICKING-TYPE BALL POINT PEN

BACKGROUND OF THE INVENTION (1) Field of the Invention

The present invention relates to improvement in a clicking-type ball point pen which solves the problem of degradation in operation reliability, assembly facilitation, and outer appearance in use of a double clicking-type (Kahn clicking-type) ball point pen that can project its writing element as a writing member by depressing a clicking rod at its rear end to enable writing and can retract the writing element by further depressing the clicking rod, so that not only the problems of deterioration with age, air replacement, and assembly facilitation are solved but also general appearance both in and after use, the operation reliability, and operability are improved particularly when the ball point pen is an inexpensive medium-viscosity clicking-type ball point pen with a medium ink viscosity in which a larger-diameter writing element is loaded.

(2) Description of the Prior Art

A conventionally available easy-to-operate so-called double clicking-type ball point pen with a good operational feeling, which repeats projection and retraction of its writing element by only repeatedly depressing a clicking rod, generally uses a small-diameter, tube-like oil-based ball point pen writing element having an ink storage tube with a diameter equal to or smaller than 5 mm. Since an oil-based ink ball point pen has a high ink viscosity and cannot ensure a sufficiently large ink flow rate, a line drawn with it is subjected to starving and it cannot write lightly. Problems of blobbing or dotting in which the ink stays in the point assembly to drop onto the paper at a certain instant, and back leaking in which the ink undesirably leaks from the rear end side, are present. With a sliver-type water-based ball point pen, the ink tends to cause feathering, the outflow amount of the ink gradually decreases, and the remaining ink amount cannot be seen from the outside. In recent years, a medium-viscosity type ball point pen, the ink viscosity of which is set at a medium level between that of a conventional oil-based ink and that of a conventional sliver-type ink and which has a large ink amount and can write lightly, has been appearing on the market. In the conventional medium-viscosity water-based ball point pen, a cap having a rubber seal member at its distal end is indispensable to prevent volatilization of the ink from the point assembly.

With the medium-viscosity type ball point pen as well, back leaking of the ink and direct leaking of the ink in which the ink leaks from the point assembly occur. Air enters the point assembly due to vibration to cause starving. Small bubbles in the ink grow or expand during long-term storage to change the internal pressure, thus causing starving. In the worst case, follower fluid at the rear end is pushed out by this pressure outside the writing element to dry or cause back leaking of the ink. In particular, if the ball point pen is of a clicking-type ball point pen having no cap, it is significant that these problems be solved. The present inventor and applicant made inventions disclosed in, e.g., Japanese Patent Application Laid-Open Hei 8 Nos. 72479, 142577, and 230386, and proposed a clicking-type ball point pen which uses a medium-viscosity type writing element and a safety mechanism that does not soil the clothing. A ball point pen in which a long shelf life and assembly facilitation, and an improvement in general appearance by employing a large-diameter writing element are achieved and developed, is sought for.

The present invention mainly aims at improving a popular ball point pen. It is sought for that a mechanism, which prevents the clothes from being accidentally soiled when the ball point pen is put into the clothes' pocket and which facilitates projection and retraction of the writing element without interfering with the smooth operation during projection or retraction of the writing element or with the writing operation, be employed to provide particularly very inexpensive components and assembly, so that the problems of cost, general appearance, and assembly are solved. In particular, when a writing element whose ink storage tube has a larger diameter than that of a conventional oil-based ball point pen is loaded because the ink flow rate is higher than that of a general oil-based ball point pen, an air replacing channel cannot be easily ensured, back leaking tends to occur, and the bubbles in the ink remain to cause problems of deterioration with age. It is sought for that these problems be solved. If the ball point pen is a clicking-type ball point pen in which a further larger-diameter writing element is loaded in the barrel cylinder and moved, the writing element sometimes comes into contact with the interior of the barrel cylinder to cause an operation error, or to form a scuff mark. Then, the ink visibility, which is the characteristic feature of the medium-viscosity type ball point pen, tends to be impaired.

SUMMARY OF THE INVENTION

It is an object of the present invention to provide a ball point pen free from the problems described above. The gists of the present invention that achieve this object are as follows.

The first gist of the present invention resides in a medium-viscosity ink clicking-type ball point pen having a so-called double clicking mechanism, which includes a writing element, that has a writing portion at a distal end thereof and that directly stores an ink having an ink viscosity of 50 cp to 5,000 cp at 23° C.±5 ° C., which is a medium viscosity as a ball point pen, in an ink storage tube, a spring for urging the writing element backward, a clicking rod loosely fitted in interlocking with the writing element to project from a rear end of a barrel cylinder, and a rotor which is rotated through a predetermined angle by a clicking operation with at least two inclined cam surfaces, wherein the clicking rod is depressed to project the writing element from a front portion of a barrel cylinder to maintain a writable projected state, and engagement is canceled by further depressing the clicking rod to retract the writing element, is characterized in that all following conditions 1) to 3) are satisfied:

1) the writing element and a return spring are movably interposed between a step portion in a distal end side of a front barrel cylinder and the rotor rotatably arranged in a rear barrel cylinder and prevented f rom being removed therefrom, at least one undercut is formed in an inner surface of the rear barrel cylinder or a component fixed to the rear barrel cylinder, during assembly, the clicking rod and the rotor can be caused to pass through the undercut and be assembled if being forced from the front, and when the front barrel cylinder is removed for exchange of the writing element, the rotor and the clicking rod are prevented from being removed forward from the barrel cylinder;

2) an air channel 12 or vent that does not close an air replacing hole 13 formed near a rear end 9 of the writing element is formed in the rotor, and a combination of respective components near the rotor constitutes air communicating means that can communicate with outer air; and 3) the barrel cylinder incorporates the writing element having a comparatively large diameter in which a maximum outer diameter of the ink storage tube is not less than 3.5 mm and not more than 8.5 mm, a point assembly holder 2 at the distal end of the barrel cylinder has a straight portion, which constantly urges a writing ball forward with a load of 1 g to 80 g, and an elastic portion having spring properties integrally with the straight portion, or in a contact state with the straight portion if the straight portion and the elastic portion are separate components, and an ink present from an interior of the point assembly to a follower is defoamed such that a gas, e.g., air, water vapor, and a gas formed of a vaporized organic solvent, which is larger than 0.524 $mm^3$ (a volume of a sphere having a diameter of 1.0 mm) is absent therein.

The second gist of the present invention resides in a clicking-type ball point pen according to the first gist described above, which is characterized in that the step portion at a front end of or in the rotor that abuts against a rear end of the writing element has a tapered surface so as to center the writing element toward an axis.

The third and fourth gists of the present invention reside in a clicking-type ball point pen according to the first and second gists described above, which is characterized in that the front barrel cylinder and the rear barrel cylinder are threadably mounted on each other by forming a male thread and a female thread thereon, respectively, the female thread portion of the rear barrel cylinder which is made of a resin and the undercut of the rear barrel cylinder for removal prevention are integrally formed simultaneously during resin molding, the female thread portion of the rear barrel cylinder is set to have an inner diameter not less than that of the undercut, the undercut serves to prevent removal of the rotor, and the inner diameter of the undercut is set to be larger than an outer diameter of the ink storage tube and smaller than a maximum outer diameter of the rotor.

The fifth to eighth gists of the present invention reside in a clicking-type ball point pen according to the first to fourth gists described above, which is characterized in that the rear barrel cylinder and the ink storage tube are made of a transparent or translucent resin to enable the ink in the writing element to be seen from an outside, when the writing element moves back and forth upon a clicking operation, an outer diameter or rear end of the writing element can come into contact with at least any two of the undercut formed in the rear barrel cylinder or in a component fixed to the rear barrel cylinder, the rotor, and the inner diameter of the front barrel cylinder, and a viewing portion to which a scuff mark is not formed is arranged in the rear barrel cylinder.

As described in the above gists, the clicking-type ball point pen according to the present invention has a so-called double-clicking mechanism including a writing element, that has a writing portion at a distal end thereof, a spring for urging the writing element backward, and a clicking rod interlocked with the writing element to project from the rear end of a barrel cylinder. When the clicking rod is depressed to project the writing element from the front end hole of the barrel cylinder, a writable projected state is obtained. When the step portion in the barrel cylinder or the ball engaging portion of a clip fixed to the barrel cylinder engages with the engaging rib of the rotor, a projected state is held. A cam surface is formed on the barrel cylinder or a component fixed to the barrel cylinder (to be referred to as a barrel cylinder hereinafter). The rotor has a cam projection which moves and rotates in interlocking with the cam to project and retract the writing element. The rotor is arranged between the clicking rod and the writing element before the clicking rod. The clicking rod and rotor respectively have a clicking rod cam and a rotor clicking cam forming inclined cam surfaces that match them. When the clicking rod is clicked forward in the axial direction, the rotor is rotated in only a predetermined direction every predetermined angle.

The rotor repeats rotation every predetermined angle until it is turned by one revolution at a certain instant. If the undercut of the barrel cylinder, which is integrally-molded to achieve low-cost assembly and to omit some components, serves to prevent removal of the rotor and the clicking rod in the ball point pen, assembly of the ball point pen is enabled in a snap fit manner with only an inserting operation, and a low-cost and slim clicking-type ball point pen having a good general appearance can be obtained. If the barrel cylinder is made transparent, the interior of the ball point pen can be observed from the outside, so that the mechanical motion, the remaining ink amount, and the ink color can be seen. If the undercut and the writing element can come into contact with each other, or if the writing element accepting surface of the rotor is tapered so that the writing element can be easily centered to the axis, the operation becomes reliable, and a scuffmark can be prevented from being formed during use.

The writing element incorporates a spring or rubber elastic member for constantly pushing the writing ball with a weak load of 1 g to 80 g forward for the purpose of prevention of direct leaking and volatilization of the ink. A vent for ventilation is formed in the writing element near its rear end. A communicating means which is connected to this vent to communicate with the outer air is constituted by the rotor and other components of the barrel cylinder. The ink and follower are defoamed during the manufacture so that air, water vapor, or a gas formed of a vaporized solvent has a diameter equal to or smaller than 1 mm when assimilated to a sphere. It is further effective to blend a silicone-based defoaming agent in the ink, to increase the centrifugal force G applied for centrifugal defoaming, or to employ a means for vacuum defoaming, in order to prevent gases dissolved in the ink or small bubbles in the ink, that are dispersed in the ink, from growing or appearing with age.

DESCRIPTION OF THE PREFERRED EMBODIMENT

Figure 1:
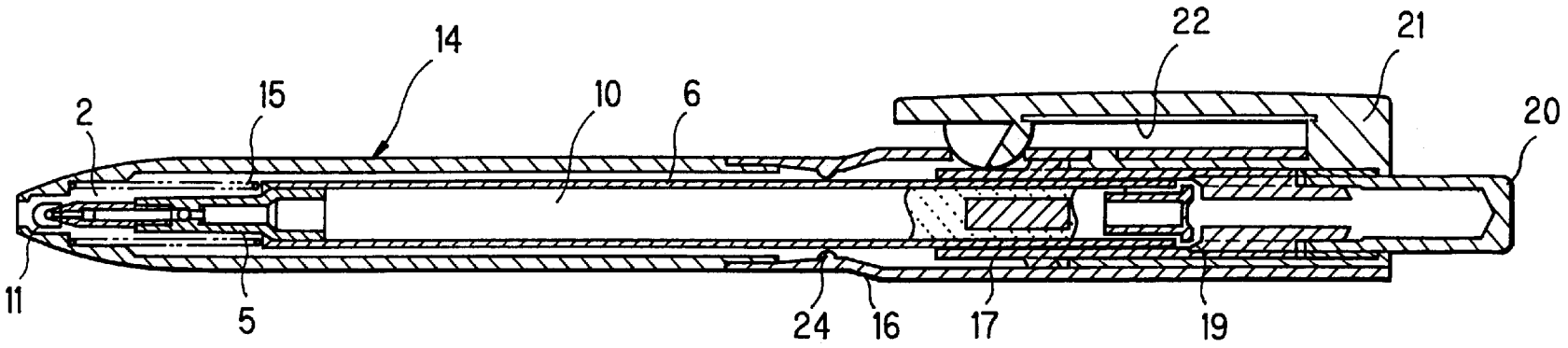
FIG. 1 is a longitudinal sectional view showing the entire portion of a ball point pen according to an embodiment of the present invention.
Figure 2:
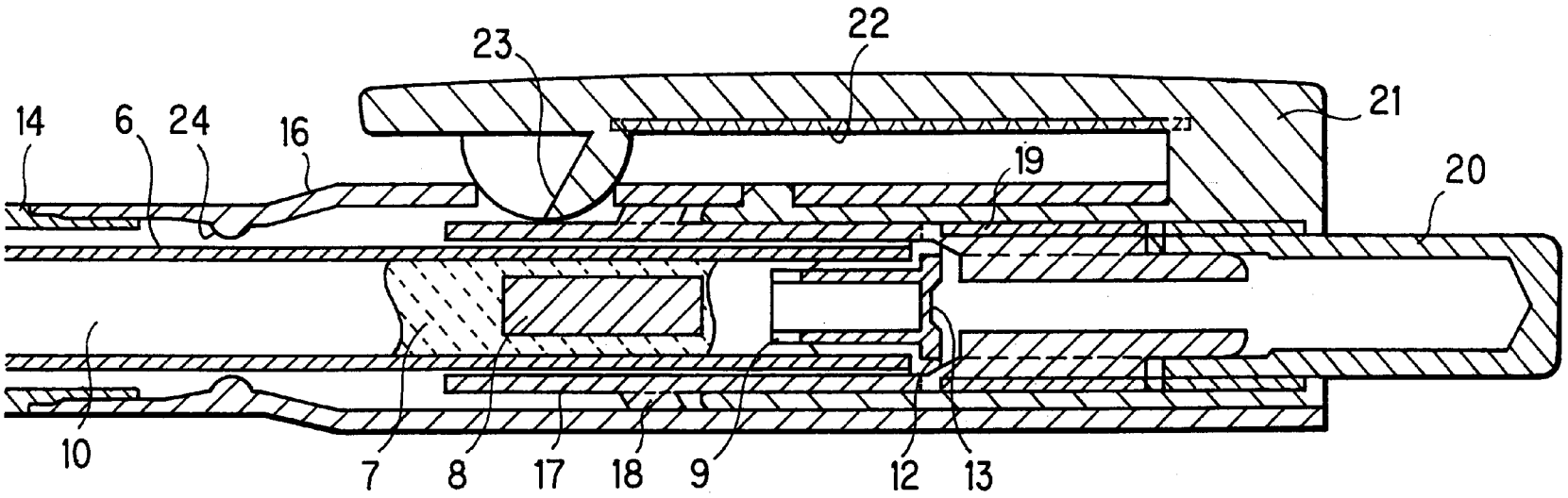
FIG. 2 is a longitudinal sectional view showing the rear end portion of the ball point pen according to this embodiment of the present invention.
Figure 3:
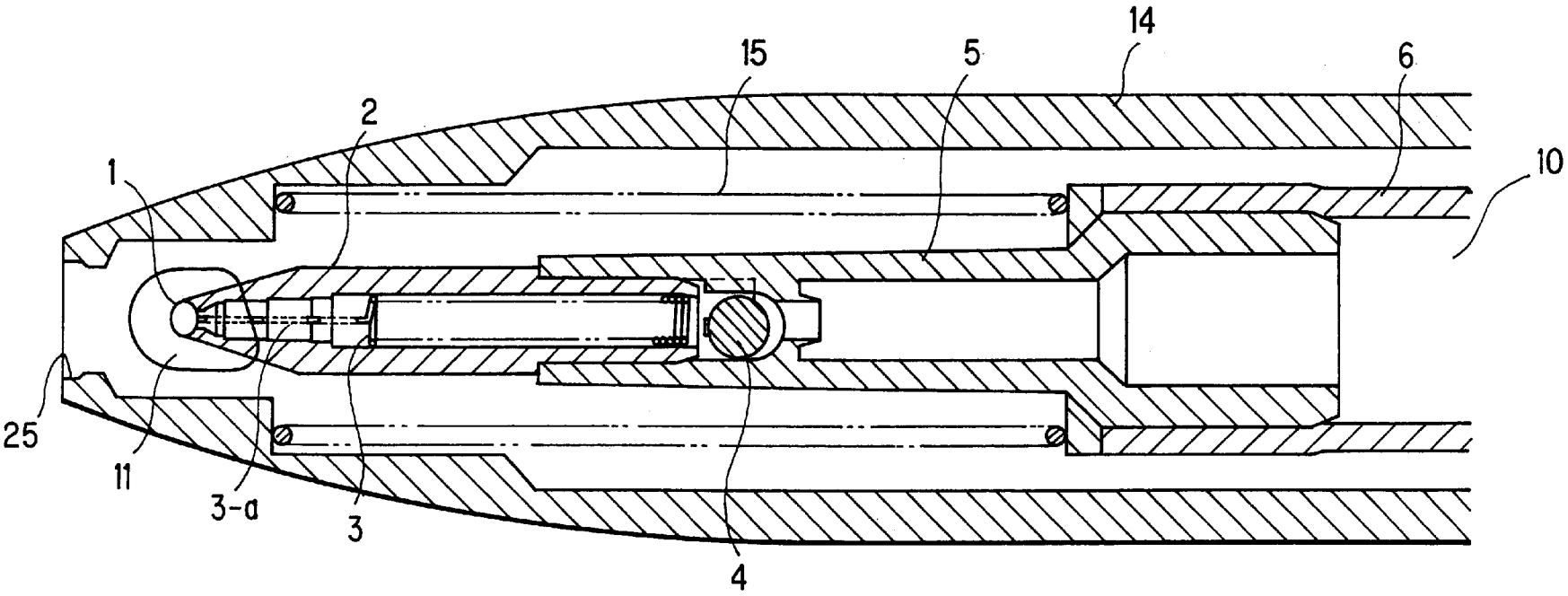
FIG. 3 is a longitudinal sectional view showing the distal end portion of the ball point pen according to this embodiment of the present invention.
Figure 4:
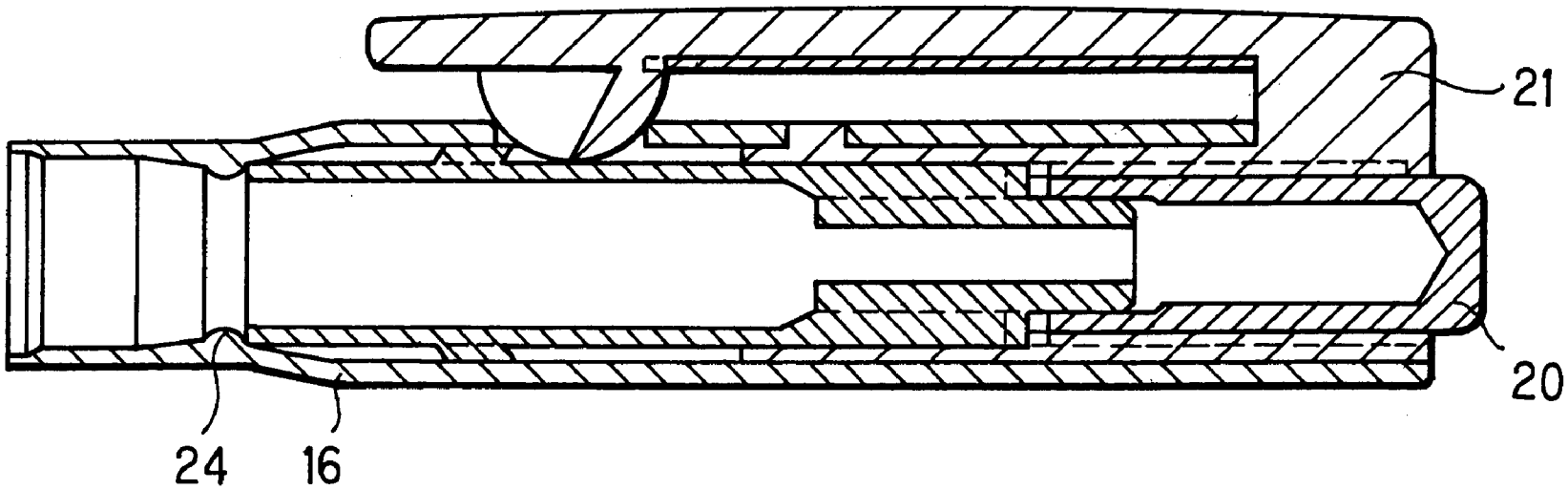
FIG. 4 is a longitudinal sectional view showing the rear barrel cylinder of the ball point pen in a disassembled state according to this embodiment of the present invention.
Figure 5:
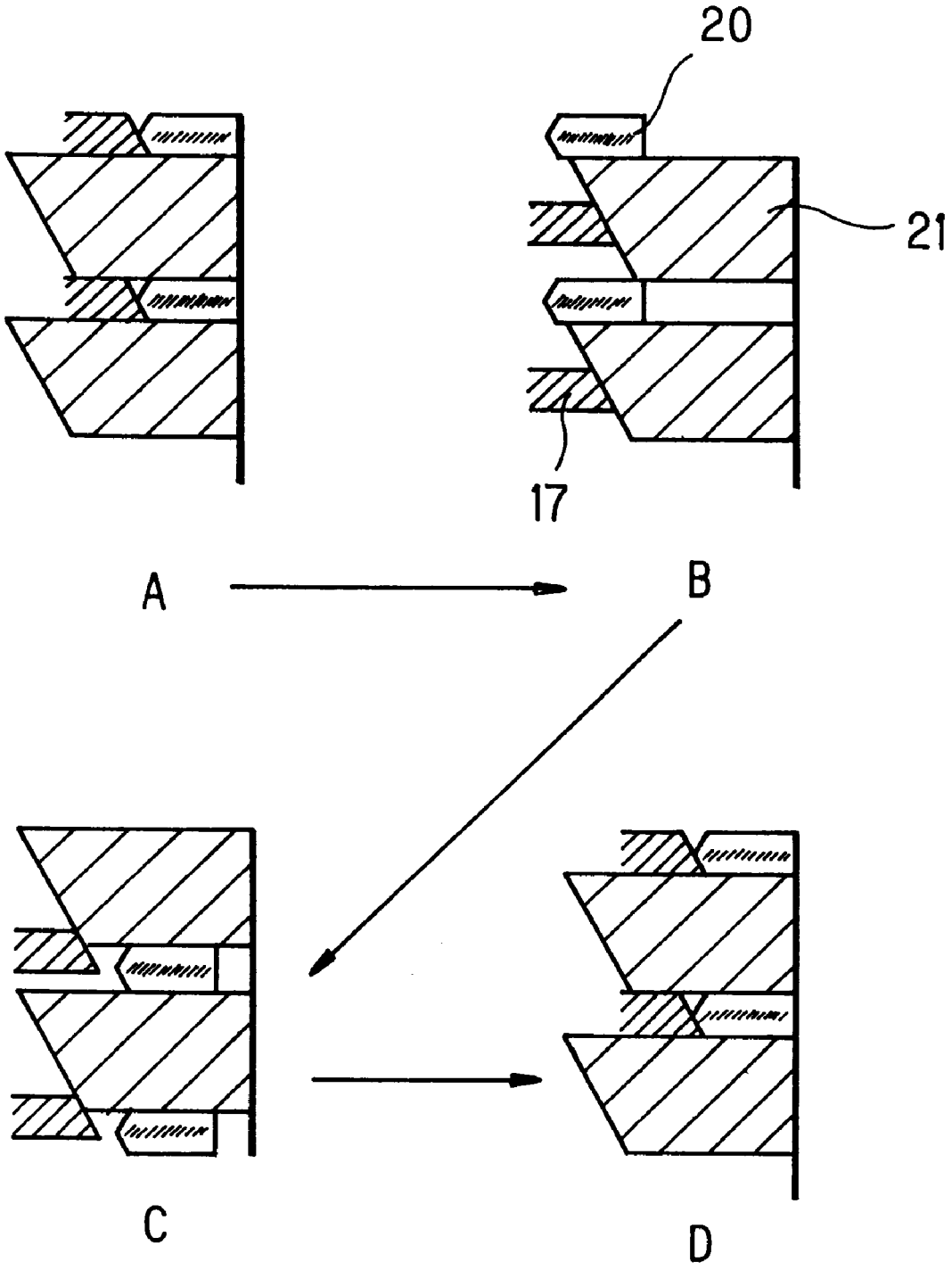
FIG. 5 schematically shows the operation of the inclined cam surface of the ball point pen according to this embodiment of the present invention.

A preferred embodiment shown in the accompanying drawings will be described. FIGS. 1 to 5 show an embodiment of the present invention. As shown in FIGS. 1 to 5, the clicking-type ball point pen incorporates a medium-viscosity type ball point pen writing element. The writing element directly stores an ink 10 in a transparent or translucent ink storage tube 6 made of a resin. A joint 5 is pressed into the storage tube 6 of the writing element on the distal end side. A ball valve seat having an ink guide hole in it at substantially its center is arranged in the writing element. An ink control ball 4 is loosely fitted in a valve chamber formed by the rear end, in the axial direction, of the point assembly and the valve seat. In ordinary writing, the ink storage portion communicates with a ball 1 serving as the writing portion. When the ball point pen is set upright, the ink control ball 4 comes into tight contact with the valve seat to prevent back leaking of the ink.

Since this writing element has a large ink flow rate, a smooth, thick line can be drawn with it. However, the writing element is a direct supply type writing element having an ink storage tube 6 with a rather large diameter of 3.5 mm to 8.5 mm and storing a medium-viscosity ink that tends to cause a problem upon reception of an impact when being stored. The writing element incorporates a so-called pseudo-plastic medium-viscosity ink added with thixotropic properties and having a viscosity of 50 cp to 5,000 cp at 23° C.±5° C., a grease-type follower 7 which is arranged in the rear portion of the writing element, does not volatilize easily, and has a higher viscosity than that of the ink 10, and a follower rod 8 made of a resin, e.g., PP or PE, having substantially the same specific gravity as that of the follower 7 so that it floats in the follower 7. In a point assembly that holds the writing ball 1 serving as a writing portion, the writing ball 1 is arranged such that it is prevented from dropping with a circumferential distal-end caulking portion. A point assembly spring 3 is also incorporated in the point assembly to urge it with a load of about 1 g to 80g. The circumferential caulking portion, which serves as the seal surface with the ball, and the writing ball form a ball valve mechanism to improve the impact resistance and to prevent volatilization of the ink 10 and back leaking and direct leaking of the ink 10. This point assembly 3 spring is usually a spring integrally formed with a straight portion at its distal end portion in order to directly urge a very small writing ball 1 having a diameter of 0.3 mm to 1.6 mm. To prevent removal of this writing ball, the rear end portion of the point assembly is caulked. When this straight portion 3-*a* is formed as a separate component, completely the same effect can be obtained if a point assembly spring 3 that comes into contact with it is arranged behind the straight portion 3-*a*.

The ink 10 and ink follower 7 are defoamed in the manufacture so that air, water vapor, or a gas formed of a vaporized solvent mixed during the manufacturing has a diameter equal to or smaller than 1 mm in the form of a sphere. The ink storage tube 6 has a rather large diameter, and its inner diameter is generally about 2 mm to 7.5 mm. When the bubbles in the ink storage tube 6 are let to expand sufficiently with age, if the diameter of the bubbles is equal to or smaller than 1 mm, merely very slight starving is caused, which is not a major problem. However, if the diameter of the bubbles exceeds 1 mm, the ink 10 and the follower 7 may be separated or the interior of the point assembly may be filled with bubbles to disconnect the ink flow, disabling writing at all.

Furthermore, to prevent gases dissolved in the ink or small bubbles in the ink, that are dispersed in the ink, from growing or appearing with age, it is effective to blend a defoaming agent or anti-foaming agent in the ink, to increase the centrifugal force G applied for centrifugal defoaming, or to perform vacuum defoaming, so that the diameter of bubbles becomes equal to or smaller than 1 mm, preferably equal to or smaller than 0.2 mm.

When a hot-melt type distal end sealing agent 11, which is fused at a temperature of 80° C. to 200° C., is applied to the distal end aiming at protection of the point assembly during transportation and prevention of ink volatilization and air trapping, the long shelf life can be further expected and troubles during transportation to the user can be prevented.

This clicking-type ball point pen has a writing element having a writing portion at its distal end, a return spring 15 for urging the writing element backward, a rotor 17 that abuts against the rear end face of the writing element, and a clicking rod 20 arranged behind the rotor and projecting from the barrel cylinder. When the clicking rod 20 is depressed to project the writing element from the front portion of the barrel cylinder, the ball point pen is set in a projected state. At this time, a step portion in the barrel cylinder or the engaging portion 23 of a component, e.g., a clip 21, attached to the barrel cylinder engages with the engaging rib 18 of the rotor 17 in the barrel cylinder to maintain the projected state. The rotor 17, which is located between the clicking rod 20 and the writing element before the clicking rod 20, and the clicking rod 20 having a rotation preventive member are loosely fitted appropriately so that they are interlocked with the writing element by a clicking operation, and are regulated by the barrel cylinder or a clip accepting portion such that, when they move backward, they can operate within only a predetermined clicking stroke.

The clicking rod 20 and rotor 17 respectively have a clicking rod cam and a rotor clicking cam forming inclined cam surfaces that match them. When the clicking rod 20 is clicked forward in the axial direction, the rotor 17 is rotated in only one direction every predetermined angle. After the clicking operation, when depression of the clicking rod 20 is stopped, the writing element is constantly urged backward by the spring, and is rotated by the cam projection of the rotor and the cam of the barrel cylinder which corresponds to this cam projection or of a component fixed to the barrel cylinder, in the same direction as that of rotation caused by the clicking rod 20 and the rotor 17 described before. More specifically, the rotor 17 repeats rotation every predetermined angle until it is turned by one revolution at a certain instant. When the writing element is projected, the cam of the inner cylinder and the cam projection of the rotor do not engage with each other (they engage with each other in an ordinary Kahn clicking-type ball point pen). If the engaging projection 18 formed on the rotor 17 engages with the engaging ball of the clip portion integrally formed with the inner cylinder, when the user tries to put the pen in the pocket with the point assembly being projected, this engagement is canceled and the point assembly is automatically retracted. In other words, this ball point pen has a so-called safety mechanism.

If an undercut 24 is formed in a component integrally molded with the barrel cylinder or fixed to the barrel cylinder by press fitting or the like, and the rotor 17 or clicking rod 20 is prevented from removal by this undercut 24, the internal mechanism can be prevented from being exposed from the rear barrel cylinder 16 when the user disassembles the ball point pen by loosening the threads of the front and rear barrel cylinders 14, 16 in order to exchange the writing element. During assembly, the rotor 17 and the clicking rod 20 can be inserted easily from the thread side of the rear barrel cylinder 16 by snap fitting. The ball point pen can be handled easily during assembly and can be assembled at a low cost. If the front barrel cylinder 14 forms a short mouth piece and the rear barrel cylinder 16 forms a long portion projecting to the distal end side, the same effect can be obtained.

Assume that a male thread is formed on the front barrel cylinder 14 and a female thread is formed on the rear barrel cylinder 16, so that the front and rear barrel cylinders 14, 16 can be threadably mounted on each other. The rear-barrel cylinder male thread portion made of a resin, and the rear barrel cylinder undercut 24 described above, which is formed for prevention of removal of the rotor 17, are formed integrally and simultaneously during resin molding. The inner diameter of the rear-barrel cylinder female thread portion is set to be equal to or larger than the inner diameter of the undercut 24. This undercut 24 prevents removal of the rotor 17. The inner diameter of the undercut 24 is set larger than the outer diameter of the ink storage tube 6 and smaller than the maximum outer diameter of the rotor 17. In this case, the number of components is decreased. If the writing element moves back and forth upon a clicking operation, generally, a lubricant such as silicone grease is often applied to the cam portion and the like to improve the operation. If a writing element having a larger diameter comes into contact with a component, e.g., the barrel cylinder, a large braking force is applied to cause an operational error. When the arrangement as described above is employed, the writing element comes into contact with the component, e.g., the barrel cylinder, through several points, so that this problem of the operational error can be solved. If the writing element accepting surface of the rotor 17 is tapered 19 so that the writing element is constantly directed to the center, the operation is further improved.

The rear barrel cylinder 16 and the ink storage tube 6 are made of a transparent or translucent resin, so that the ink 10 in the writing element can be seen from the outside. When the writing element moves back and forth upon a clicking operation, the outer diameter or rear end of the writing element can come into contact with at least two of the undercuts 24 formed in the rear barrel cylinder 16 or in a component fixed to the rear barrel cylinder 16, the rotor 17, and the inner diameter of the front barrel cylinder 14. In this case, a viewing portion to which a scuff mark is not formed even during use can be ensured in the rear barrel cylinder 16, so that this clicking-type ball point pen has a good general appearance. If the gate 25 of the front barrel cylinder 14 corresponds to the inner diameter of the point assembly, a portion behind the gate is substantially invisible to the user, and accordingly the function of the transparent barrel cylinder is further enhanced.

As other embodiments of the present invention, a medium- or low-viscosity, oil-based ball point pen, which does not employ a water-based ink but employs an oil-based ink having a viscosity slightly lower than that of an ordinary oil-based ink, can be adopted. The same effect as that of the present invention can be expected with these embodiments as well.

The function of the embodiment according to the present invention will be described. In a double clicking-type ball point pen which is rendered writable by projecting a writing element, serving as a writing member, from the distal end of the barrel cylinder upon depression of a clicking rod projecting to behind the barrel cylinder, when the locking portion of a barrel cylinder or a component fixed to the barrel cylinder engages with the engaging rib of the rotor, the projected state of the writing element is maintained. If an engaging portion is formed on the clip ball portion, when the clip is lifted, engagement is canceled, and the writing element is automatically retracted. Therefore, a trouble in which the user accidentally puts the pen in the pocket with the point assembly being projected, thus soiling the cloth, can be prevented.

When the assembly of the present invention is employed, not only an inexpensive ball point pen having an assembly facilitation can be provided, but also a clicking-type ball point pen which is excellent in direct leaking prevention, writing performance, and long shelf life can be provided even if its writing element has a larger diameter. When the barrel cylinder is made transparent, the operation of the ball point pen, the remaining ink amount, and the ink color can be observed from the outside. When the user operates the ball point pen, the barrel cylinder will not be damaged, and the above-described functions of the ball point pen can be maintained.

Furthermore, since projection and retraction of the writing element are repeated only by operating the clicking rod, no special explanation on operation need be made to the user, so that the operability is improved. Moreover, the impact applied during the return operation is converted into a rotation force by the inclined cam surfaces, and is decreased to a considerable degree because the clicking rod is in contact with the user's finger. Therefore, a medium-viscosity type writing element, which cannot be conventionally loaded, can be loaded.

The arrangement and operation of the clicking-type ball point pen according to the present invention are as described above. A ball point pen having an excellent general appearance distinguished from ordinary ones is provided, with which a serious trouble such as soiling of the clothing will not be caused. An easy-to-use ball point pen, which not only satisfies the requirement for the function as a high-safety clicking-type ball point pen, but also can be used easily by the user, can be provided. Problems in initial performance and various problems caused over long-term use can be solved. A stable-quality product, which not only has a simplified component arrangement, but also has high assembly facilitation, is inexpensive, provides good function, and endures a long-term use can be provided. Moreover, a clicking-type ball point pen which is satisfactory in the clicking operation and cost can be provided.

What is claimed is:

1. A medium-viscosity ink clicking-type ball point pen having a so-called double clicking mechanism, which includes a writing element, that has a writing portion at a distal end thereof and that directly stores an ink having an ink viscosity of 50 cp to 5,000 cp at 23° C.±5° C., which is a medium viscosity as a ball point pen, in an ink storage tube, a spring for urging said writing element backward, a clicking rod loosely fitted in interlocking with said writing element to project from a rear end of a barrel cylinder, and a rotor which is rotated through a predetermined angle by a clicking operation with at least two inclined cam surfaces, wherein said clicking rod is depressed to project said writing element from a front portion of a barrel cylinder to maintain a writable projected state, and engagement is canceled by further depressing said clicking rod to retract said writing element, characterized in that all following conditions 1) to 3) are satisfied:

1) said writing element and a return spring are movably interposed between a step portion in a distal end side of a front barrel cylinder and said rotor rotatably arranged in a rear barrel cylinder and prevented from being removed therefrom, at least one undercut is formed in one of an inner surface of said rear barrel cylinder and a component fixed to said rear barrel cylinder, such that during assembly, said clicking rod and said rotor can be caused to pass through said undercut and be assembled if being forced from the front, and such that after assembly, when said front barrel cylinder is removed for exchange of said writing element, said rotor and said clicking rod are prevented from being removed forward from a barrel cylinder;

2) one of an air channel and a vent that does not close an air replacing hole formed near a rear end of said writing element is formed in said rotor, and a combination of respective components near said rotor constitutes air communicating means that can communicate with outer air; and 3) said barrel cylinder incorporates said writing element having a comparatively large diameter in which a maximum outer diameter of said ink storage tube is not less than 3.5 mm and not more than 8.5 mm, a point assembly holder at said distal end of said barrel cylinder has a straight portion, which constantly urges a writing ball forward with a load of 1 g to 80 g, and an elastic portion having spring properties, and an ink present from an interior of said point assembly to a follower is defoamed such that a first gas and a gas formed of a vaporized organic solvent, which is larger than 0.524 $mm^3$ (a volume of a sphere having a diameter of 1.0 mm) is absent therein.

2. A clicking-type ball point pen according to claim 1 is characterized in that a front end of said rotor that abuts against a rear end of said writing element has a tapered surface so as to center said writing element toward an axis.

3. A clicking-type ball point pen according to claim 2 is characterized in that said front barrel cylinder and said rear barrel cylinder are threadably mounted on each other by forming a male thread and a female thread thereon, respectively, the female thread portion of said rear barrel cylinder which is made of a resin and said undercut of said rear barrel cylinder for removal prevention are integrally formed simultaneously during resin molding, said female thread portion of said rear barrel cylinder is set to have an inner diameter not less than that of said undercut, said undercut serves to prevent removal of said rotor, and said inner diameter of said undercut is set to be larger than an outer diameter of said ink storage tube and smaller than a maximum outer diameter of said rotor.

4. A clicking-type ball point pen according to claim 3 is characterized in that said rear barrel cylinder and said ink storage tube are made of a transparent or translucent resin to enable said ink in said writing element to be seen from an outside, when said writing element moves back and forth upon a clicking operation, one of an outer diameter and a rear end of said writing element can come into contact with at least two of said at least one undercut, said rotor, and said inner diameter of said front barrel cylinder, and a viewing portion to which a scuff mark is not formed is arranged in said rear barrel cylinder.

5. A clicking-type ball point pen according to claim 2 is characterized in that said rear barrel cylinder and said ink storage tube are made of a transparent or translucent resin to enable said ink in said writing element to be seen from an outside, when said writing element moves back and forth upon a clicking operation, one of an outer diameter and a rear end of said writing element can come into contact with at least two of said at least one undercut, said rotor, and said inner diameter of said front barrel cylinder, and a viewing portion to which a scuff mark is not formed is arranged in said rear barrel cylinder.

6. A clicking-type ball point pen according to claim 1 is characterized in that said front barrel cylinder and said rear barrel cylinder are threadably mounted on each other by forming a male thread and a female thread thereon, respectively, the female thread portion of said rear barrel cylinder which is made of a resin and said undercut of said rear barrel cylinder for removal prevention are integrally formed simultaneously during resin molding, said female thread portion of said rear barrel cylinder is set to have an inner diameter not less than that of said undercut, said undercut serves to prevent removal of said rotor, and said inner diameter of said undercut is set to be larger than an outer diameter of said ink storage tube and smaller than a maximum outer diameter of said rotor.

7. A clicking-type ball point pen according to claim 6 is characterized in that said rear barrel cylinder and said ink storage tube are made of a transparent or translucent resin to enable said ink in said writing element to be seen from an outside, when said writing element moves back and forth upon a clicking operation, one of an outer diameter and a rear end of said writing element can come into contact with at least two of said at least one undercut, said rotor, and said inner diameter of said front barrel cylinder, and a viewing portion to which a scuff mark is not formed is arranged in said rear barrel cylinder.

8. A clicking-type ball point pen according to claim 1 is characterized in that said rear barrel cylinder and said ink storage tube are made of a transparent or translucent resin to enable said ink in said writing element to be seen from an outside, when said writing element moves back and forth upon a clicking operation, one of an outer diameter and a rear end of said writing element can come into contact with at least two of said at least one undercut, said rotor, and said inner diameter of said front barrel cylinder, and a viewing portion to which a scuff mark is not formed is arranged in said rear barrel cylinder.

* * * * *